US007198271B1

(12) United States Patent
Thomas

(10) Patent No.: US 7,198,271 B1
(45) Date of Patent: Apr. 3, 2007

(54) COMBINED EDUCATIONAL TOOL FOR IMPARTING THEMATIC KNOWLEDGE AND REINFORCING RELATED CORE PRINCIPLES

(76) Inventor: Darryl Thomas, 5603 Green Ct., Baltimore, MD (US) 21244

( * ) Notice: Subject to any disclaimer, the term of this patent is extended or adjusted under 35 U.S.C. 154(b) by 46 days.

(21) Appl. No.: 11/119,778

(22) Filed: May 3, 2005

(51) Int. Cl.
*A63F 3/00* (2006.01)

(52) U.S. Cl. ..... 273/272; 273/249

(58) Field of Classification Search ..... 273/242, 273/243, 249
See application file for complete search history.

(56) References Cited

U.S. PATENT DOCUMENTS

| | | | | |
|---|---|---|---|---|
| 4,121,823 | A | 10/1978 | McBride | |
| 4,201,388 | A | 5/1980 | Cantelon | |
| 4,572,513 | A | 2/1986 | Evans | |
| 4,640,513 | A * | 2/1987 | Montijo | 273/249 |
| 5,042,816 | A | 8/1991 | Davis et al. | |
| 5,071,133 | A | 12/1991 | Smith | |
| 5,092,606 | A | 3/1992 | Miller | |
| 5,152,535 | A | 10/1992 | Roberts | |
| 5,224,862 | A | 7/1993 | Sullivan | |
| 5,246,373 | A * | 9/1993 | Becker | 434/129 |
| 5,295,834 | A | 3/1994 | Saunders | |
| 5,449,177 | A | 9/1995 | Naylor | |
| 5,743,528 | A | 4/1998 | Downey-Jerome | |
| 6,267,376 | B1 | 7/2001 | Jenkins | |
| 6,547,245 | B1 | 4/2003 | Olutunfese | |
| 2003/0227132 | A1 | 12/2003 | Martin | |
| 2004/0119229 | A1 | 6/2004 | Foreman | |

* cited by examiner

*Primary Examiner*—Vishu K. Mendiratta
(74) *Attorney, Agent, or Firm*—Rosenberg, Klein & Lee

(57) ABSTRACT

A combined instructional tool (10) is provided for imparting theological or other thematic knowledge to a plurality of participants while experientially reinforcing a core principle relating thereto. The tool (10) generally includes a game board (100), a plurality of categorized knowledge stores (200–230), at least one supplemental store (300), and a user-operable selector (400). The game board (100) defines a plurality of spaces (110) which progress between designated starting and end points, wherein at least a portion of the spaces (100) are formed with at least three types of indicia. The question stores (200–230) each include a plurality of predetermined thematic questions for selection and consideration by the participants, whereas the supplemental store (300) includes a plurality of redemptive tokens (3010). During use, participants take turns attempting to advance along the spaces (110), at each space complying with appropriate indicia which may include directives to select and answer a question from the question store. Upon failure to adequately answer the question, a participant is afforded an opportunity for redemption by selecting a potentially redemptive token from the supplemental store (300).

17 Claims, 3 Drawing Sheets

COMBINED EDUCATIONAL TOOL FOR IMPARTING THEMATIC KNOWLEDGE AND REINFORCING RELATED CORE PRINCIPLES

BACKGROUND OF THE INVENTION

1. Field of the Invention

The subject educational tool is generally directed to a system and method for expanding the base of certain thematic knowledge of users, and experientially reinforcing in them one or more core principles deriving or otherwise relating to that knowledge. More specifically, the subject educational tool brings a plurality of participants together in an interactive game setting to both challenge and encourage one another to not only grow in just thematic knowledge, but to demonstrably experience core principles they commonly share in accordance with that knowledge.

Fundamental to any society are morality- or faith-based institutions to which persons holding to certain fundamentally shared ideologies, hopes, and beliefs belong. Prevalent examples of such institutions are found in churches, synagogues, temples, mosques, and other religious organizations which promote teachings meant to positively impact members' lives and guide their daily conduct. In the Christian context, for example, theological knowledge based upon the books of the Bible is disseminated and conduct in accordance with biblical principles is actively encouraged for growth in the faith. Yet, outside of periodic worship, Bible study, or other ministry-based activities, scarcely few activities exist which a group of individuals may readily engage in together, to cooperatively gain meaningful knowledge and training in the Christian faith. The same is true in other contexts as well. Whether in religious and non-religious contexts, there exists a need for simple yet effective tools with sufficient procedural structure to yield meaningfully teaching while evoking reasonably free yet instructive interplay of the participants.

Given the relational nature of institutions in these contexts, members tend naturally to gravitate towards one another. They often socialize together outside perhaps the more formal activities of the given institution, spending much time in personal fellowship with one another. In those settings, party game-type activities are as popular as they are in many social circles. The element of friendly competition they provide fuels prolonged periods of friendly interplay between participants during which good-natured joking, spontaneous reactions, and infectious laughter typically occur to make for a fun, engaging experience. The resulting environment is normally one of such camaraderie and support that participants may be left with particularly strong impressions of instructive elements if effectively incorporated into a given game-type activity.

There is a need, therefore, for a tool by which a base of theological, biblical, or other thematic knowledge may be meaningfully imparted to groups of individuals in an informal setting. There is a need, moreover, for such tool for concurrently reinforcing core principles relating to the base of knowledge. There is a need for such tool which is capable of non-intrusively incorporating instructional elements in these respects within a game-type activity that engenders a suitably engaging and supportive environment for meaningful instruction of the participants to occur.

2. Prior Art

Educational games for enhancing knowledge are known in the art, as are educations board games specifically directed to enhancing knowledge of the Bible. The best prior art known to Applicant includes U.S. Pat. Nos. #5,224,862; #5,092,606; #4,572,513; #6,267,376; #4,201,388; #4,121,823; #5,042,816; #5,071,133, #5,152,535; #5,295,834; #5,449,177; #5,743,528; and #5,547,245. The known prior art also includes published U.S. patent applications No. 2004/0119229 and No. 2003/0227132.

Such known prior art games, however, are heavily directed to enhancing and reinforcing knowledge of the given subject matter. Accordingly, they rely primarily upon quizzing means, merely adding elaborate game board design features and emphasizing certain competitive elements to heighten the participants' interests. Such prior art games, however, do not provide the degree of simplicity and effectiveness realized by the present invention in an instructional tool that utilizes a modest level of competition to encourage engaging and edifying interaction between the participants over prolonged periods of play. Nor do the prior art games effectively combine knowledge enhancement with experiential reinforcement of certain demonstrable core principles relating to that knowledge.

SUMMARY OF THE INVENTION

A primary object of the present invention is to provide a system and method whereby a base of thematic knowledge may be imparted meaningfully to individuals while one or more core principles relating to that base of knowledge is experientially reinforced in them.

It is another object of the present invention to provide a system and method that enables participants to engage in a friendly competitive activity which brings about theological or other thematic instruction in an entertaining and engaging way.

It is yet another object of the present invention to provide a tool for simply and conveniently effecting theological, biblical, or other thematic instruction in a competitive game setting.

These and other objects are attained in a system and method implemented in accordance with the present invention. In one exemplary embodiment, there is provided a combined instructional tool for imparting to a plurality of participants theological or other thematic knowledge and experiential reinforcement of a core principal relating thereto. This tool comprises generally a game board, a plurality of categorized question stores, at least one supplemental store, and a selector. The game board defines a plurality of spaces progressing from a starting point to an end point, wherein at least a portion of the spaces each have formed thereon indicia of at least first, second, and third type. The first type of indicia includes one of a plurality of knowledge directives, while the second type of indicia includes one of a plurality of predetermined markers, and the third type of indicia includes one of a plurality of punitive directives. Each of the question stores preferably includes a plurality of predetermined thematic questions for selection and consideration by the participants, whereas each supplemental store preferably includes a plurality of redemptive tokens, each having at least one of the predetermined markers. The selector operates to randomly select an advancement parameter.

During use, the participants in turn each advance to a selected one of the game board spaces responsive to actuation of the selector. A participant at a selected space then selects a thematic question from the question store corresponding to the selected space. The participant is under compulsion to comply with the punitive directive of that selected space upon failing to respond correctly to the thematic question. That is so, unless the participant is freed from such compulsion by selecting from the redemptive tokens one which corresponds sufficiently to the selected space.

DETAILED DESCRIPTION OF THE PREFERRED EMBODIMENTS

Figure 1:
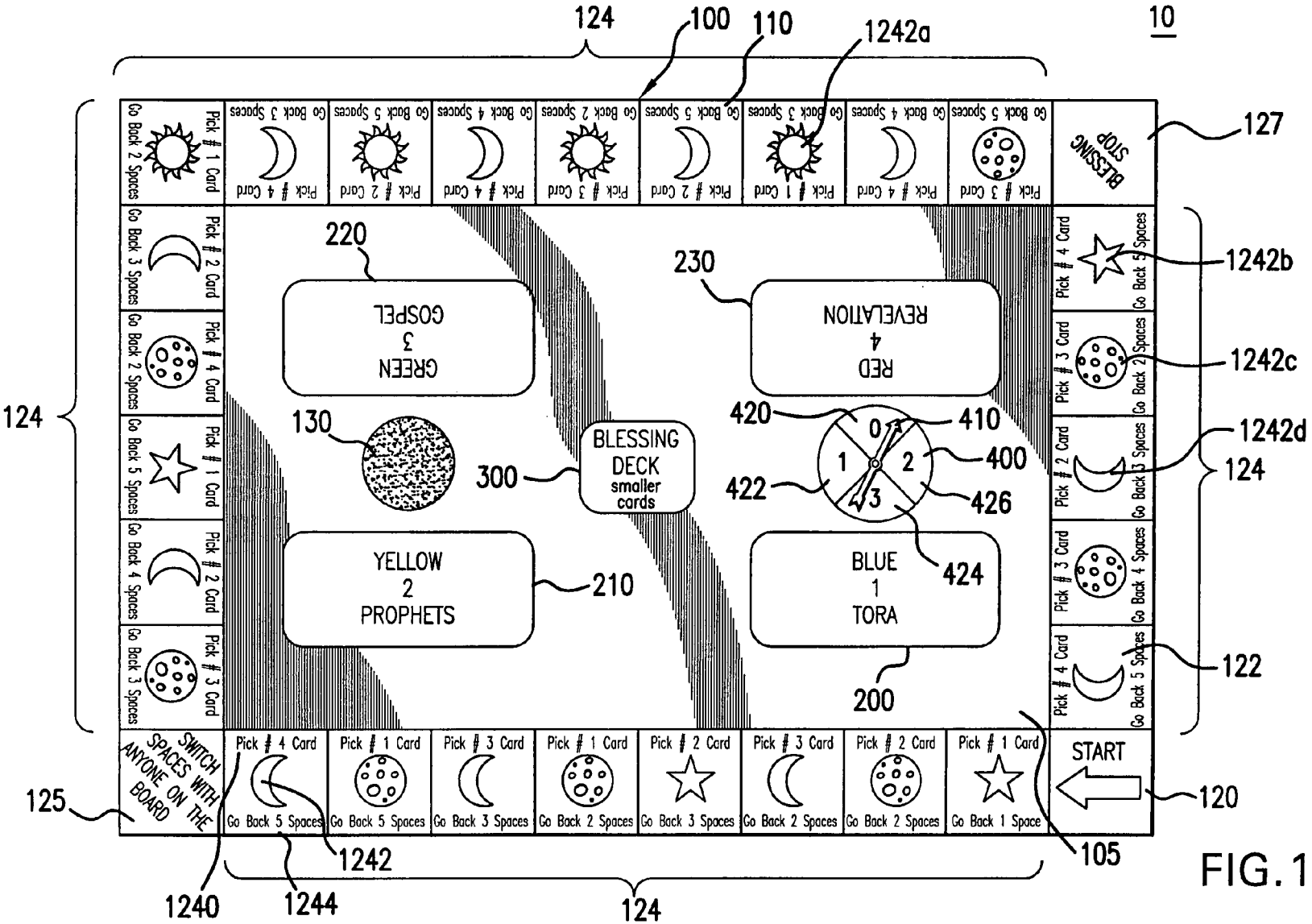
FIG. 1 is an illustrative plan view of an exemplary embodiment of a game board formed in accordance with the present invention.

Referring now to FIG. 1, there is shown an instructional system 10 formed in accordance with one exemplary embodiment of the present invention. The system 10 in this embodiment includes a game board 100 on which are defined a plurality of spaces preferably arranged to form a circuitous path from a starting point designated, for instance, by a dedicated start space 120 to an end point designated by a preselected one of the spaces, such as space 122, or by the start space 20 itself. In the embodiment illustrated, the start space 120 includes a direction indicator to signify the direction in which advancement over the arranged spaces 110 is to occur.

Also in the embodiment illustrated, the spaces 110 are arranged peripherally about the board 100 so as to extend about a common region 105 and return to the start space 120. In alternate embodiments, however, any suitable arrangement of spaces 110 may be employed. Such things as the number of spaces 110, configuration of the path formed thereby, the shape and general appearance of each space 110, and the like may be varied in any suitable manner known in the art to appropriately reflect the purposes and requirements of the particularly intended application.

The spaces 110 defined on the game board, or game surface, 100 include a plurality of active spaces 124 and preferably one or more special spaces 125, 127 interspersed therein. Each of the active spaces 124 preferably includes at least three different indicators discernibly formed thereon. The first type 1240 indicates which of a plurality of question categories a question should be drawn from. The second indicator type 1242 depicts one of a plurality of predetermined markers shown in various active spaces 124. The third indicator type 1244 preferably communicates a punitive directive.

The special spaces 125, 127 provide a temporary haven from the requirements and potential consequences associated with each of the active spaces 124. For instance, the special space 127 in the embodiment shown illustrates a "blessing" stop which effectively affords the participant arriving at that space pause to rest there a turn without the pressure of earning or otherwise acquiring the right to remain at that space, and avoid regression. In contrast, the special space 125 is illustrated to be one which affords a participant arriving at that space the added right to switch spaces with any other participant. These are but examples of the many special spaces that may be suitable defined on the game board 100. The number and location of such special spaces may also be varied in alternate embodiments from that illustrated in the embodiment shown.

Preferably disposed within the common region 105 of the game board 100 are a plurality of knowledge, or question, stores 200, 210, 220, 230 each corresponding to a distinct category of thematic questions. In the example illustrated, the application is theological in nature, and the question stores 200, 210, 220, 230 are grouped respectively in such distinct biblical categories as the Torah (encompassing the first five books of the Bible, namely, Genesis, Exodus, Leviticus, Numbers, and Deuteronomy), Prophets, Gospel (the first five books of the New Testament, namely, Matthew, Mark, Luke, John, and Acts), Revelation, and the like. Of course, these question store categories are purely exemplary, and may be suitably varied both in number and subject matter content depending on the requirements and purposes of the intended application.

Preferably, measures are taken to render question stores 200, 210, 220, 230 conspicuously distinguishable one from the other, visually or otherwise. In addition to simply labeling with a category name or symbol, for instance, each store 200, 210, 220, 230 may be assigned a distinguishing color, such as blue, yellow, green, red, and the like, such that question cards or other contents of a particular store may be quickly and easily distinguished as such by the participants. This not only minimizes the potential for confusion during use, it facilitates simple set up and orderly storage of system 10.

Figure 2B:
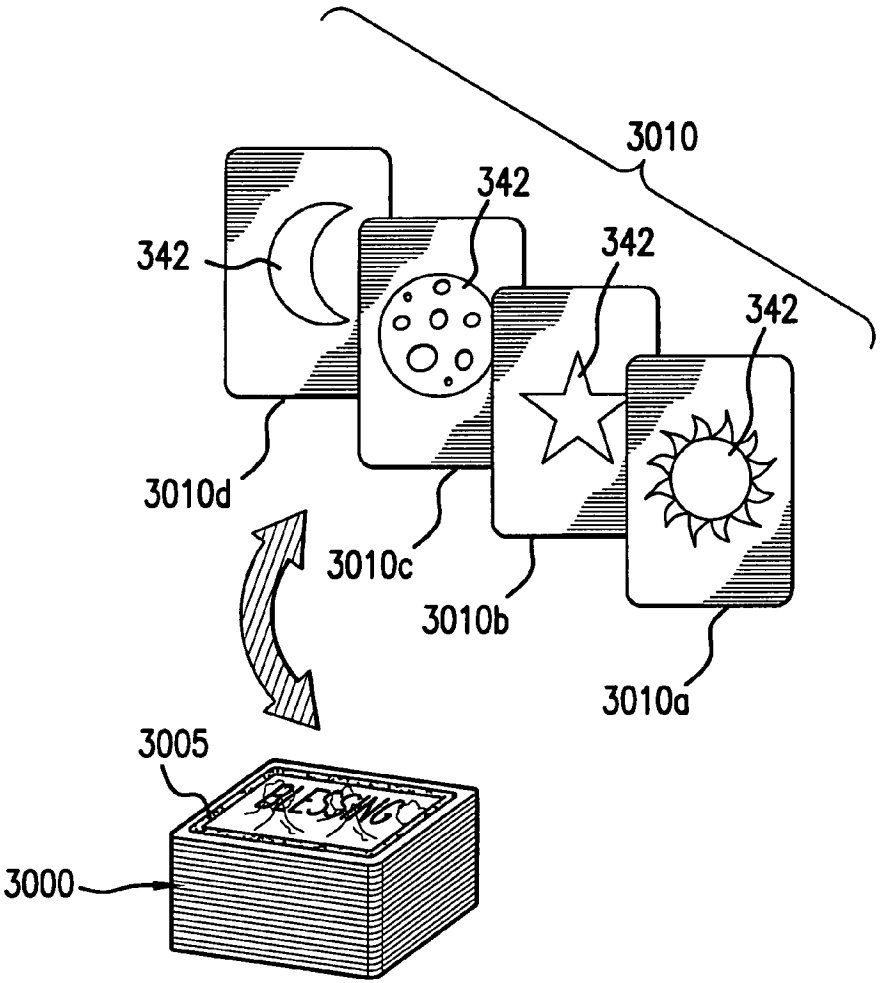
FIG. 2B is an illustrative schematic view of an exemplary card deck forming a supplemental store in accordance with an exemplary embodiment of the present invention; and, FIG. is an illustrative schematic diagram representing the intercoupling of functional units of an exemplary electronic store employed in an alternate embodiment of the present invention.
Figure 2A:
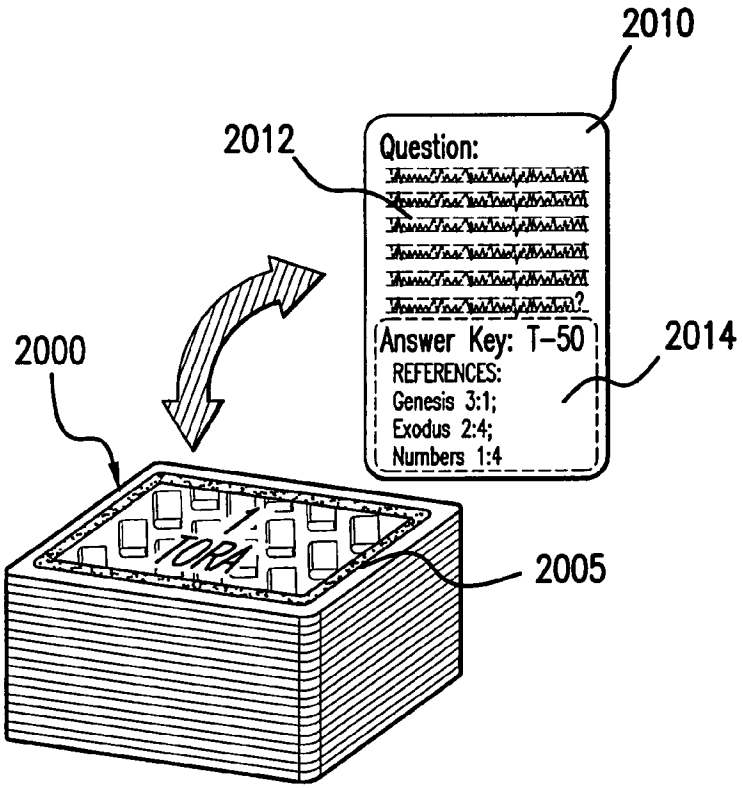
FIG. 2A is an illustrative schematic view of an exemplary card deck forming a knowledge store in accordance with an exemplary embodiment of the present invention.

As shown in FIG. 2A, each of the question stores 200, 210, 220, 230 in the exemplary embodiment illustrated is preferably formed as a categorized deck 2000 of cards 2010 each uniformly marked with the appropriate color, label, and/or other distinguishing graphic indicia on its backing 2005. A front surface of each card 2010 bears one or more questions 2012 pertaining to its store category, which are ascertained and answered by a participant during play. An answer reference (not shown) may be provided in printed, electronically recorded, or any other suitably accessible form to provide a quick and simple check to determine whether a responsive answer is in fact correct.

Appropriate auxiliary information pertaining to the question 2012 may also be provided on this face of the card 2010. Where incorporated, such auxiliary information 2014 in the biblical application illustrated may include helpful information like an answer key pointer ("T-50" for example) for use by the participant to quickly and accurately find the correct corresponding answer to the question(s) in an answer reference. Such auxiliary information 2014 may also include other information like citations supporting biblical passages, or other suitable annotations which may serve to enrich the educational capacity of the given card 2010.

A supplemental store 300 is also provided preferably within the common region 105 in the exemplary embodiment shown. While likewise illustrate in FIG. 2B as a deck 3000 of smaller cards 3010*a*, 3010*b*, 3010*c*, 3010*d*, this supplemental store 300 may be realized in numerous other suitable forms known in the art. The supplemental store 300 provides from one of a plurality of redemptive tokens to be randomly selected therefrom, preferably with weighted probabilities as described in following paragraphs.

The blessing deck 3000 is shown in the embodiment to include distinct sets of cards 3010*a*–3010*d*; however, such cards 3010*a*–3010*d* are uniformly marked with a suitable color, label, and/or other distinguishing graphic indicia on their backings 3005. Preferably, the cards 3010*a*–3010*d* are also formed uniformly in additional respects, such as in dimension, contour, and/or other configurational features to conspicuously distinguish from the question store cards 2010 employed. Each of these blessing deck cards 3010*a*–3010*d* preferably represents a redemptive token, with the front surfaces on cards of each set 3010*a*, 3010*b*, 3010*c*, or 3010*d* bearing a common marker 342 that includes one or more of the markers 1242 shown in the active game board spaces 124.

The probability of each particular one of the predetermined markers 1242*a*–1242*d* appearing on a blessing card 3010*a*–3010*d* selected from the blessing deck 3000 is weighted by varying the numbers of blessing cards respectively bearing the predetermined markers 1242*a*, 1242*b*, 1242*c*, and 1242*d*. That is, the likelihood of drawing a redemptive token matching an active space 124 is selectively weighted in part by appropriately controlling the numbers of cards in the card sets 3010*a*, 3010*b*, 3010*c*, 3010*d* which are dispersed in the deck 3000.

In the example shown, different astronomical symbols like: a sun, a star, a full moon, and a crescent moon, are shown in different active spaces 124. The number of spaces 124 occupied by each of these symbols is preferably varied. For example, the sun marker 1242*a* and the star marker 1242*b* each occupy four of the spaces 124, whereas the full moon marker 1242*c* occupies eight spaces 124, and the crescent moon marker 1242*d* occupies eleven spaces 124 in the embodiment shown. The numbers of corresponding blessing cards 3010*a*–3010*d* may be varied accordingly, such that the cards 3010*a*, 3010*b* including either the sun marker 1242*a* or the star marker 1242*b*, for instance, may each number ten cards while those including the full moon marker 1242*c* may number seven cards, and those including the crescent moon marker 1242*d* may number three cards. This is but one example of numerous other suitable quantitative combination which may be employed to control the likelihood of a predetermined marker 1242 of a selected one of the active spaces 124 corresponding to a card 3010*a*–3010*d* selected from the blessing deck 3000.

Referring again to FIG. 1, an auxiliary space 130 may also be included in certain alternate embodiments within the common region 105, to implement special variations from normal play of system 10. For example, one or more selectable elements in the question stores 200, 210, 220, 230 may be of wild card type which relegate one or more of the participants to a holding area delineated by this auxiliary space 130. As another example, one or more of the game board spaces 110 may by themselves, or, perhaps, in certain combination with a selective action coincidently taken by the participant, similarly relegate participants to such holding area. Release from that holding area may then be conditioned upon a suitably predefined event, such as the subsequent selection of a pre-designated card, the occurrence of a preset number of play turns, the participant's performance of a certain deed, the actuation of a random selector to a predefined result, or the like.

A selector 400 is preferably also provided to effect random determination of the space 110 which a participant will occupy during a turn. The selector 400 is shown for illustration as a pivotally displaceable pointer, or spinner, 410 which may be actuated by participants to randomly select from a plurality of quantitative value-demarcated regions 420, 422, 424, 426.

While it is shown situated in the common region 105 of the game board 100, the selector 400 may alternatively be formed in certain embodiments as a free or detachable unit that may be conveniently passed around by participants during play. The selector 400 may be formed with an alternate configuration of any suitable type known in the art capable of actuation to randomly select from amongst a plurality of selectable options, quantitative or otherwise.

Referring back to the spaces 110 defined on the game board 100, each of the active spaces 124 includes a plurality of indicia types 1240, 1242, 1244 as described in preceding paragraphs. Each such indicia type serves to communicate particular directives and/or information to a participant occupying that active space 124. While the indicia in the illustrated embodiment visually convey directive/information to participants, they may in alternate embodiments employ such other forms of communication as tactile and/or audible means, should the intended application require.

In the embodiment illustratively shown, the first type of indicia 1240 preferably includes a variety of knowledge directives which, in the given example, directs a participant at an active space 124 to draw a question card from at least one question store 200, 210, 220, or 230 specified. These question stores may be textually indicated by numeric references such as the "#1," "#2," "#3," "#4" references shown, or by any other suitable means. The directives may be varied over active spaces 124 in any pre-selected manner suitable for the intended application.

The second type of indicia 1242 the active spaces 124 preferably include various predetermined markers for possible match with a corresponding marker formed on a card drawn from the blessing deck 3000. These predetermined markers 1242*a*–1242*d* may take numerous forms including, but not limited to, graphic symbols or signs, background colors, textual characters, thematic labels, and the like. In the examples shown, the astronomic symbols for a sun 1242*a*, star 1242*b*, full moon 1242*c*, and crescent moon 1242*d* are illustratively employed These symbols 1242*a*–1242*d* are arranged over the active spaces 124 such that at least one symbol 1242*a*–1242*d* occupies each active space 124.

To contribute a weighting factor to the attempted match of a particular symbol 1242*a*–1242*d* with that found on a card randomly drawn from the blessing deck 3000, these symbols 1242*a*–1242*d* may be provided with different frequency on the active spaces 124. For example, the sun symbol 1242*a* and the start symbol 1242*b* may each occupy four of the active spaces 124, while the full moon symbol 1242*c* and crescent moon symbol 1242*d* may respectively occupy eight and eleven of the active spaces 124. As mentioned in preceding paragraphs, the respective numbers of blessing deck cards 3010 respectively bearing these symbols 1242*a*–1242*d* are preferably varied in corresponding inverse relation to the numbers of active spaces 124 in which these symbols 1242*a*–1242*d* are found on the game board 100. The likelihood of a participant's selecting a matching blessing card 3010 is rendered thereby commensurate with the rarity of the symbol 1242*a*, 1242*b*, 1242*c*, or 1242*d* specified by the active space 124 at which the participant finds him-/herself.

The third type of indicia 1244 preferably includes a variety of punitive directives to be imposed upon the participant should he or she fail to adequately answer the question(s) selected at the given space 124, and should the blessing card 3010 drawn at that space not provide relief. In the example shown, this punitive directive is a positional one, directing the participant to retreat a pre-specified number of spaces from the given active space 124. For instance, such directives may require the participant to go back one to five spaces, as shown.

Such punitive directives have the beneficial effect of prolonging the 'game' which in turn, extends the opportunity for the participants' further learning. In alternative embodiments, punitive directives may include various other consequences such as credits/debits to in a point system, instructions for one or more of the participants to perform certain other actions like singing a song, carrying out an errand (or other subservient task), making a humorous gesture, and the like. Any other directives suitable and appropriate for the intended application may be employed.

An added benefit deriving from these punitive directives is that they present demonstrable opportunities for redemption. Where participants draw penalties upon themselves, they are consistently afforded the opportunity to avail themselves of an unearned blessing that would bring them out from under the imposed penalties. In this way, the participants are reminded, potentially at each turn they take, of such principles as grace, forgiveness, atonement, mercy, second chances, starting anew, and the like—which may be among those principles at the core of beliefs underlying the thematic subject matter of system 10.

A variation that may be added in alternate embodiments within the illustrated example's biblical context includes substitutionally imputing to another the penalties which had been drawn by a participant. Where a matching blessing card 3010 is drawn, for instance, redemption of the drawing participant would be fully consummated only upon the substitutional satisfaction of that penalty by a designated other. That other may be a pre-designated individual, or a volunteer designated in accordance with the blessing card 3010.

Turning now to FIG. is, there is schematically shown an electronic store 500 which maybe used with, or in place of, the card decks 2000, 3000 an exemplary alternate embodiment of the present invention. Implemented using any suitable hardware/software means known in the art, electronic store 500 preferably includes input and output measures 502, 504 available for the participants through a user input/output (I/O) interface 510. The I/O interface 510 preferably includes suitable audio and/or video display means by which questions, directives, indicators, and other information may be communicated to or received from a participant. The I/O interface 510 preferably also includes key or printing device entry means for the convenient input of information by participants. Preferably, the I/O interface 510 would include a voice box-type portion to audibly verbalize at least the question being presented to a participant upon appropriate actuation during a given turn.

The verbalized question may be electronically synthesized, or simply pre-recorded for audible playback when needed. A respected voice familiar to the participants may then be used to enhance credibility as to the knowledge conveyed therethrough, or to assure command of the participants' collective attention. This may be particularly effective where the answers, too, are provided in audibly verbalized form.

Electronic store 500 further includes, preferably, a controller 520 to which are coupled not only the user I/O interface 510, but a question memory 530 and an answer memory 530', as well as a supplemental memory 540. The controller 520 is suitably programmed to automatically control operation, and the requisite access and flow of information to, from, and between these units in appropriate manner.

The respective memories 530 and 530' include in electronically stored form each of the categorized questions 5300, 5310, 5320, 5330 and their corresponding answers 5300', 5310', 5320', and 5330'. The supplemental memory 540 includes each of the n distinctive redemptive tokens 5400*a*–5400*n* to be used in the intended application.

During use, a participant enters through the I/O interface 510 selection of a question category 5300–5330 stored in question memory 530. The controller 520 then processes the requested selection to either randomly, or in another suitably predefined manner, retrieve a question from the appropriate category for presentation to the participant through the I/O interface 510. Upon receiving the participant's entered response, the controller 520 consults the answer memory 530' and determines the acceptability of that response and communicates accordingly to the participant, again through the I/O interface 520. Where the response is determined to be unsatisfactory, the controller 520 causes the I/O interface 510 to also present the correct answer, unless otherwise directed by one or more of the participants.

At a suitable point thereafter, the controller 520 randomly selects from the redemptive tokens 5400*a*–5400*n* stored in supplemental memory 540. Again, unless otherwise prompted by one or more of the participants, the controller 520 presents the retrieved redemptive tokens 5400*a*–5400*n* to the participant via the I/O interface 510. The redemptive tokens 5400*a*–5400*n* are preferably weighted in their probabilities of selection. The weighting preferably reflects the relative number of active spaces 124 respectively corresponding to those tokens 5400*a*–5400*n*.

Although the question and answer memories 530, 530' and supplemental memory 540 are separately represented in the schematic illustration shown, they may be implemented either within one or within more than one memory device, depending on the requirements of the intended application. In addition, although not shown, the selector 400 may also be electronically implemented and coupled to the controller 520 for operational control and access in certain alternate embodiments.

During typical play of the exemplary embodiment illustrated in FIGS. 1–2B, each of a plurality of participants begins at the start space 120 and takes turns to advance in the indicated direction over the spaces 110. The 'game' may end when one or more participants arrive at the designated end space. Although not shown, distinctive figurines or other tokens may be used to monitor each participant's progress over the spaces 110.

Each turn preferably involves a participant actuating the selector 400 to randomly determine the number of spaces by which to advance. In the embodiment shown, the selector 400 includes a region 420 indicating no advancement. In the event the selector selects this region, a participant would remain at his or her present space and comply with the directives indicated thereon, unless the present space happens to be either the start space 120 or the blessing stop space 127 which are without active directives. The participant then simply remains at the space until the next turn.

The participant otherwise advances to the space as indicated by the selector 400 and follows what directives may be found at that space. If the participant thus selects and arrives at an active space 124, the participant complies with the first directive and draws one or more questions from the appropriate question store 200–230. Preferably, the question(s) drawn is read out loud so that it may be heard by all the participants for their collective edification. The participant drawing the question attempts to answer correctly. Afterward, a check is made of the given answer reference to determine the sufficiency of the response. If the response is determined to be insufficient, the correct answer may be verbalized out loud, again for the collective edification of all the participants. In the alternative, one or more other participants may be given the opportunity to answer correctly, perhaps to earn certain predefined game benefits or privileges.

If a participant provides sufficient response to the question(s), he or she remains at the selected space, and the next participant takes a subsequent turn. If, on the other hand, the participant fails to provide a sufficient response, the participant may avail him-/herself to a card 3010 drawing from the blessing deck 3000. If the marker 342 revealed on that drawn blessing card 3010 corresponds to the maker 1242 of the selected space 124, the participant is permitted to remain at that space 124 notwithstanding the space's punitive directive 1244. Otherwise, the participant must comply with the punitive directive and 'go back' the number of spaces indicated.

As described in preceding paragraphs, the likelihood of drawing an actually redemptive token—that is, a blessing card 3010 which actually matches the selected space's marker 1242—may vary from space to space. Preferably, where a more common one of the symbols 1242*a*–1242*d* appears in the marker 1242 of the selected space, the more rarely a corresponding blessing card 3010*a*–3010*d* will appear in the blessing deck 3000. Still, a participant is brought to experience after each unsuccessful turn at answering a knowledge-based question the freely offered chance at redemption.

Play proceeds with the participants cycling through turns in this manner until one or more of the participants reach the designated end point. The interactive process in the meantime promotes natural discussion and collaboration regarding the subject matter presented by the various questions that are taken up in the process. At any time during play, pause may be taken either as part of a normal turn or as a special instructive feature to look up and consider the authoritative references and/or other annotations which may, for example, be included as auxiliary information 2014 on one or more of the question cards 2010. This furthers the participants' collective edification, solidifying and expanding the knowledge gained from the questions and answers.

The game may be effectively accelerated or slowed by suitable varying the contents of the selector 400. Instead of the selectable values 0–3 shown in the exemplary embodiment, for instance, higher or lower quantitative values may be used.

It is quite conceivable (and indeed desirable), that the questions originally provided in the various question stores 200–230 may come to be sufficiently exhausted, such that to certain individuals, they are of minimal further use. That is, these individuals would have become familiar enough with the questions to have mastered the subject matter covered thereby, making the answers somewhat academic for them. In accordance with one aspect of the present invention, then, question in one or more of the knowledge stores 200–230 may the be replenished with replacement questions borne on replacement cards 2010. In this manner, additional categories may be newly-added, and certain of the categories may be wholly replaced with others.

Figure 3:
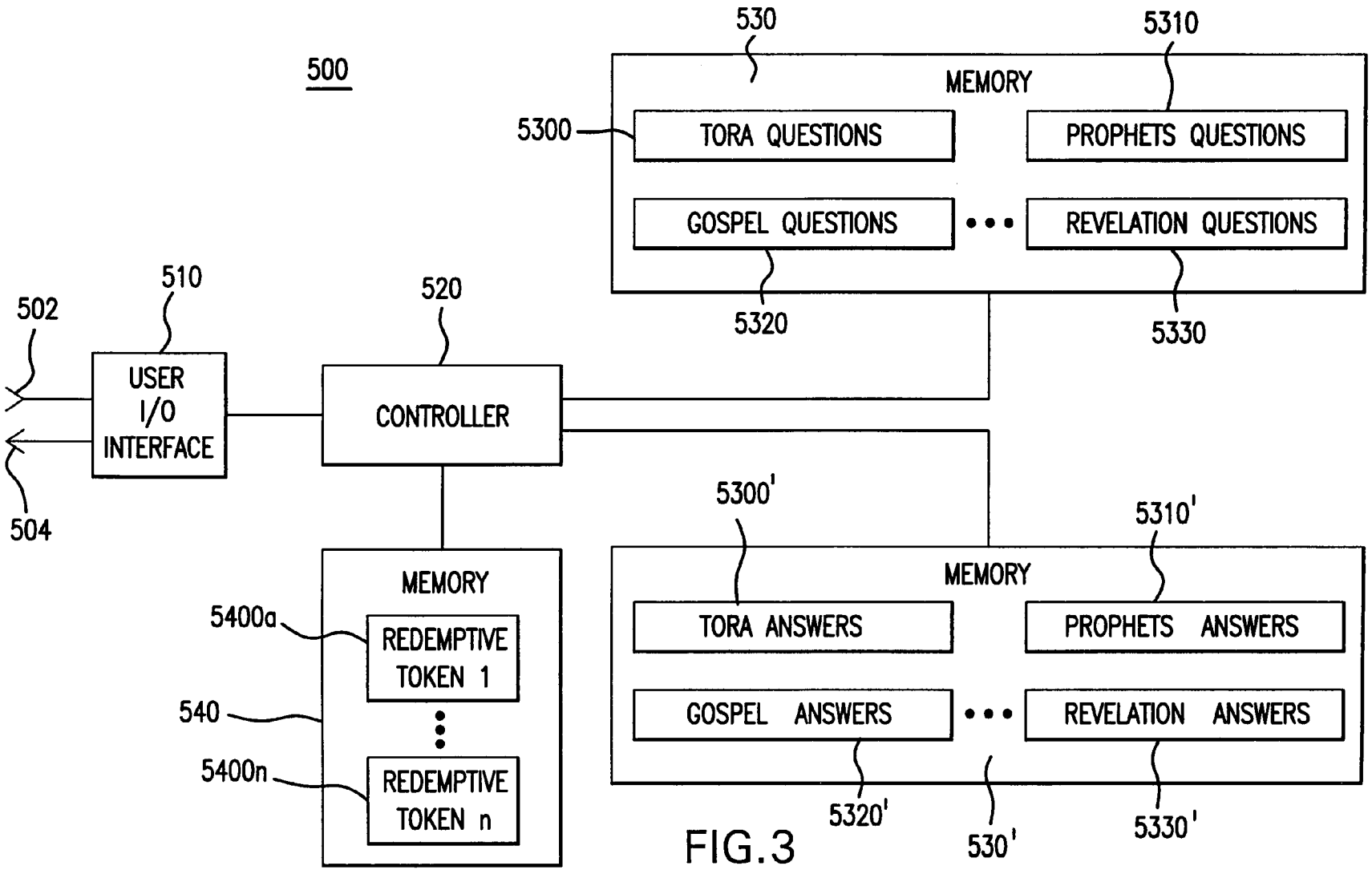

In the electronic embodiment illustrated in FIG. 3, the contents of the question and answer memories 530, 530' may be similarly updated. One or more of the question stores and corresponding answer stores 5300—5330, 5300'–5330' may be added to or overridden with additional questions and answers to effect the update.

Regardless of the particularities of the embodiment actually employed in a given application, updates may be obtained by the user on an as-needed basis. Alternatively, periodic updates may be obtained with more regularity on a subscription basis to keep play of system 10 continually challenging and completing to prospective participants. Additionally, groups of past and future participants may share and recycle the questions to further encourage collective edification.

Although this invention has been described in connection with specific forms and embodiments thereof, it will be appreciated that various modifications other than those discussed above may be resorted to without departing from the spirit or scope of the present invention. For example, equivalent elements may be substituted for those specifically shown and described, certain features may be used independently of other features, and in certain cases, particular combinations of method steps may be reversed or interposed, all without departing from the spirit or scope of the invention as defined in the appended claims.

What is claimed is:

1. A combined instructional tool for imparting theological or other thematic knowledge and experiential reinforcement of a core principle relating thereto to a plurality of participants comprising:

a. a game board defining a plurality of spaces progressing from a starting point to an end point, at least a portion of said spaces each having formed thereon indicia of at least first, second, and third type;

i. said first type of indicia including one of a plurality of knowledge directives;

ii. said second type of indicia including one of a plurality of predetermined markers, each of said markers corresponding to a weighted opportunity for redemption from a punitive consequence;

iii. said third type of indicia including one of a plurality of punitive directives imposing said punitive consequence;

b. a plurality of categorized question stores, each said question store including a plurality of predetermined thematic questions for selection and consideration by the participants;

c. at least one supplemental store each including a plurality of redemptive tokens, each of said redemptive tokens including a marker corresponding to at least one of said predetermined markers, a proportional number of said spaces having one of said predetermined markers being inversely related to a proportional number of said redemptive tokens having said marker corresponding thereto; and, d. a selector operable to randomly select an advancement parameter value;

whereby the participants in turn each advance to a selected one of said game board spaces responsive to actuation of said selector and select a thematic question from said question store corresponding to said selected space; each participant compulsively complying with said punitive directive of said selected space upon failing to respond correctly to said thematic question, unless freed from such compulsion by selection from said redemptive tokens one corresponding to said selected space.

2. The combined instructional tool as recited in claim 1, wherein said question stores are electronically maintained, each of said predetermined thematic questions being electronically reproducible responsive to selective user actuation.

3. The combined instructional tool as recited in claim 1, wherein each said question store includes a plurality of question cards having a common backing, each said question card having formed on an inner side at least one of said predetermined thematic questions.

4. The combined instructional tool as recited in claim 1, wherein said question stores are updatable to replenish at least a portion of said predetermined thematic questions with replacement thematic questions.

5. The combined instructional tool as recited in claim 1, wherein categories for said question stores are Biblical, and include at least: a Tora category, a Prophets category, a Gospels category, a Revelations category.

6. The combined instructional tool as recited in claim 5, wherein said predetermined markers include a plurality of graphic astronomical images.

7. The combined instructional tool as recited in claim 6, wherein said punitive directives include textual instructions to retreat preselected numbers of spaces from said selected space on said game board.

8. The combined instructional tool as recited in claim 7, wherein said supplemental store includes a plurality of blessing cards forming said redemptive tokens, said blessing cards having a common backing, each said blessing card having formed on a front side at least one of said predetermined markers.

9. The combined instructional tool as recited in claim 8, wherein said game board includes a plurality of special spaces each defining a haven from said first, second, and third indicia; at least one of said special spaces including indicia denoting a positional option for a user.

10. A combined method of competitively enlarging a thematic knowledge base and experientially reinforcing core principles deriving therefrom for a plurality of interactive participants comprising the steps of:

a. establishing a board defining a plurality of spaces progressing from a starting point to an end point, at least a portion of said spaces each having formed thereon at least one of a plurality of knowledge directives, at least one of a plurality of predetermined markers, and at least one of a plurality of punitive directives, each of said predetermined markers corresponding to a weighted opportunity for redemption from a punitive consequence imposed by one of said punitive directives;

b. establishing and categorizing a plurality of question stores according to predefined concepts within a base of thematic knowledge, each said question store including a plurality of predetermined questions for selection and consideration by the participants;

c. establishing a plurality of redemptive tokens, each of said redemptive tokens including a marker corresponding to at least one of said predetermined markers, a proportional number of said spaces having one of said predetermined markers being inversely related to a proportional number of said redemptive tokens having said marker corresponding thereto;

d. prompting the participants in turn to:

i. advance to a randomly selected one of said game board spaces;

ii. select and answer one of said questions from said question store responsive to said question directive of said selected space;

iii. determining correctness of the answer in accordance with a predefined reference;

iv. responsive to said determination alternatively:

preserving said advancement of the participant to said selected space; or, imposing upon the participant a requirement to comply with said punitive directive of said selected space;

vi. upon imposition of said requirement, granting the participant at least one opportunity to be released therefrom by selecting from said redemptive tokens one corresponding to said predetermined marker of said selected space, whereby the participant is permitted to preserve the advancement to said selected space notwithstanding the imposition of said requirement; and, e. repeating step d in turn for the participants until said selected space for at least one of the participants coincides with said end point.

11. The combined method as recited in claim 10, wherein said question stores are electronically stored in updatable manner, each of said predetermined questions being electronically reproducible responsive to user-selected retrieval thereof.

12. The combined method as recited in claim 10, wherein said question stores are Biblically categorized to include at least: a Torah category, a Prophets category, a Gospels category, a Revelations category.

13. The combined method as recited in claim 10, wherein said punitive directives include instructions to retreat by preselected numbers of spaces from said selected space on said game board.

14. The combined method as recited in claim 10, wherein the relative quantities of said game board spaces having one of said predetermined markers and said game board spaces having at least one other of said predetermined markers is inversely proportional to the relative quantities of said redemptive tokens having said one of the predetermined markers and said redemptive tokens having the other of said predetermined markers.

15. A game system for augmenting Biblical knowledge of a plurality of participants and experientially reinforcing a core Biblical principle comprising:

a. a game board having a plurality of spaces defined about a common region to progress from a starting point to an end point, at least a portion of said spaces each having formed thereon at least one of a plurality of category directive, at least one of a plurality of predetermined markers, and at least one of a plurality of punitive directives, each of said predetermined markers corresponding to a weighted opportunity for redemption from a punitive consequence imposed by one of said punitive directives;

b. a plurality of updatable question categories disposed in said common region, each said question category including a plurality of predetermined Biblical questions for selection and consideration by the participants;

c. a plurality of commingled redemptive token sets disposed in randomly selectable manner in said common region, said redemptive token sets including markers corresponding to respective ones of said predetermined markers, wherein a proportional number of said game board spaces having one of said predetermined markers is inversely related to a proportional number of said redemptive tokens having said marker corresponding thereto and, d. a selector operable to randomly select an advancement parameter value;

whereby the participants in turn each advance to a selected one of said game board spaces responsive to actuation of said selector and select a Biblical question from said question category corresponding to said selected space;

a requirement to comply with said punitive directive of said selected space being imposed upon failure of the participant to correctly answer said Biblical question; the participant being granted at least one opportunity to be released from said requirement by selecting from said commingled redemptive token sets a redemptive token corresponding to said predetermined marker of said selected space, whereby the participant is permitted to remain at said selected space notwithstanding the imposition of said requirement.

16. The game system as recited in claim 15, wherein said predetermined questions are selectably stored in a form selection from the group consisting of: electronically stored data form and hard printed form.

17. The game system as recited in claim 15, wherein said predetermined question categories are updatable to replenish at least a portion of said predetermined questions with replacement questions.

* * * * *